US010414203B2

(12) United States Patent
Lin

(10) Patent No.: US 10,414,203 B2
(45) Date of Patent: Sep. 17, 2019

(54) MULTI-FUNCTION WRITING IMPLEMENT

(71) Applicant: Chin-Cheng Lin, Taichung (TW)

(72) Inventor: Chin-Cheng Lin, Taichung (TW)

(73) Assignee: Chin-Cheng Lin, Taichung (TW)

( * ) Notice: Subject to any disclaimer, the term of this patent is extended or adjusted under 35 U.S.C. 154(b) by 14 days.

(21) Appl. No.: 15/396,821

(22) Filed: Jan. 3, 2017

(65) Prior Publication Data

US 2017/0225506 A1 Aug. 10, 2017

(30) Foreign Application Priority Data

Feb. 4, 2016 (TW) ..... 105201873 U

(51) Int. Cl.

| | |
|---|---|
| ***B43K 27/04*** | (2006.01) |
| ***B43K 27/00*** | (2006.01) |
| ***B43K 27/02*** | (2006.01) |
| ***B43K 27/08*** | (2006.01) |
| ***B43K 27/12*** | (2006.01) |
| ***B43K 8/04*** | (2006.01) |
| ***B43K 1/00*** | (2006.01) |
| ***B43K 29/05*** | (2006.01) |

(52) U.S. Cl.

CPC ..... *B43K 27/00* (2013.01); *B43K 1/006* (2013.01); *B43K 8/04* (2013.01); *B43K 27/003* (2013.01); *B43K 27/006* (2013.01); *B43K 27/02* (2013.01); *B43K 27/04* (2013.01); *B43K 27/08* (2013.01); *B43K 27/12* (2013.01); *B43K 29/05* (2013.01)

(58) Field of Classification Search

CPC .... B43K 27/00; B43K 27/003; B43K 27/006; B43K 27/02; B43K 27/04; B43K 27/08; B43K 27/12; B43K 29/05

USPC ..... 401/17, 34, 35, 23

See application file for complete search history.

(56) References Cited

U.S. PATENT DOCUMENTS

| | | | | |
|---|---|---|---|---|
| 5,895,160 | A * | 4/1999 | Ginelli | B43K 15/00 401/133 |
| 6,179,501 | B1 * | 1/2001 | Fulop | B43K 27/08 401/34 |
| 6,491,464 | B1 * | 12/2002 | Young | B43K 27/04 401/17 |
| 7,018,122 | B2 * | 3/2006 | Kwan | B43K 1/006 401/28 |
| 7,452,146 | B2 * | 11/2008 | Godbout | B43K 27/12 401/16 |
| 8,403,577 | B2 * | 3/2013 | Khoshnevis | B41J 3/36 401/35 |
| 9,470,628 | B2 * | 10/2016 | Durham | B43K 27/08 |
| 2009/0257811 | A1 * | 10/2009 | Brachman | B43K 1/12 401/34 |

(Continued)

*Primary Examiner* — Jennifer C Chiang

(57) ABSTRACT

A multi-function writing implement includes a pen shaft, a colored pen assembly, and an erasing pen assembly. The colored pen assembly is arranged at one end of the pen shaft. The colored pen assembly includes a cartridge seat, a nib seat, a plurality of colored cartridges, a plurality of relay cartridges, and a plurality of colored ink cotton tubes. The erasing pen assembly is arranged at the other end of the pen shaft opposite to the colored pen assembly. Only one end of the pen shaft may have at least two colors for providing the user to use different colors and the user is not necessary to use two nibs respectively arranged at two ends of the pen shaft by replacing in turn.

5 Claims, 4 Drawing Sheets

(56) References Cited

U.S. PATENT DOCUMENTS

| | | | | |
|---|---|---|---|---|
| 2014/0270888 | A1* | 9/2014 | Yeum | B43K 27/12<br>401/17 |
| 2016/0046142 | A1* | 2/2016 | Dashe | B43K 27/08<br>401/34 |
| 2017/0087922 | A1* | 3/2017 | Dorpmund | A45D 40/24 |

* cited by examiner

MULTI-FUNCTION WRITING IMPLEMENT

FIELD OF THE INVENTION

The present invention relates to a writing implement, and more particularly to a multi-function writing implement whose one end may draw at least two colors.

BACKGROUND OF THE INVENTION

The conventional ink pens, such like markers or highlighters, are generally used for marking, so their nibs must be thicker. Therefore, lots of them only have the ink cotton tube for each with single color.

However, the pen with single color for marking is dull and hard to exactly show where the marks are. To resolve it, the user must buy many pens with different colors. For consumers, they waste additional cost and are hard to carry.

The above mentioned colored ink pen limited by the thicker nib is not able to use many press lock structures to perform many cartridges and ink cotton tubes with different colors. Therefore, in the market, many colored ink pens are arranged two cartridges and two ink cotton tubes with two different colors which are respectively arranged at two ends of the pen shaft. When the user is using, the caps respectively covered at the two ends of the pen shaft must be opened (or separated from the corresponding end of the pen shaft) and the two different colors may be used by changing two ends of the pen shaft in turn.

In addition, the nib of the conventional ink pen is directly connected to the ink cotton tubes that the nib may be deformed or broken by overpressing or incorrect writing posture after a long time.

In view of the foregoing circumstances, the inventor has invested a lot of time to study the relevant knowledge, compare the pros and cons, research and develop related products. After quite many expetireents and tests, the "multi-function writing implement" of this invention is eventually launched to improve the foregoing shortcomings, to meet the public use.

SUMMARY OF THE INVENTION

An object of this invention is providing a multi-function writing implement. Only one end of the pen shaft may have at least two colors for providing the user to use different colors and the user is not necessary to use two nibs respectively arranged at two ends of the pen shaft by replacing in turn.

To achieve above objects, a multi-function writing implement may comprise a pen shaft; a colored pen assembly, arranged at one end of the pen shaft and including: a cartridge seat, connected to the end of the pen shaft; a nib seat, connected to the cartridge seat, one end of the nib seat has a plurality of cartridge slots; a plurality of colored cartridges, respectively arranged at the cartridge slots; a plurality of relay cartridges, respectively connected to the colored cartridges and arranged in the cartridge seat; and a plurality of colored ink cotton tubes, respectively connected to the relay cartridges and arranged in the pen shaft and the cartridge in parallel; and an erasing pen assembly, arranged at the other end of the pen shaft opposite to the colored pen assembly, the erasing pen assembly includes: an erasing cartridge; and an ink erasing cotton tube, connected to the erasing cartridge.

In some embodiments, the number of the cartridge slots, the colored cartridges, the relay cartridges, and the colored ink cotton tubes is two.

The multi-function writing implement may further comprise a spacing assembly arranged between the colored pen assembly and the erasing pen assembly.

In some embodiments, the spacing assembly includes: a first spacing stopper, having two semi-circular grooves for receiving the colored ink cotton tubes; and a second spacing stopper, having a circular groove for receiving the ink erasing cotton tube.

In some embodiments, the first spacing stopper further includes a convex end and the second spacing stopper further includes a wedge slot, and the convex end is fastened to and corresponding to the wedge slot.

In some embodiments, the pen shaft has a tapered seat for providing the erasing cartridge to arrange.

The multi-function writing implement may further comprise two caps, one of the two caps covers the cartridge seat and the other one of the two caps covers the tapered seat.

In some embodiments, the nib seat is made of transparent materials.

Further features and advantages of the present invention will become apparent to those of skill in the art in view of the detailed description of preferred embodiments which follows, when considered together with the attached drawings and claims.

BRIEF DESCRIPTION OF THE DRAWINGS

All the objects, advantages, and novel features of the invention will become more apparent from the following detailed descriptions when taken in conjunction with the accompanying drawings.

DESCRIPTION OF THE PREFERRED EMBODIMENT

Figure 1:
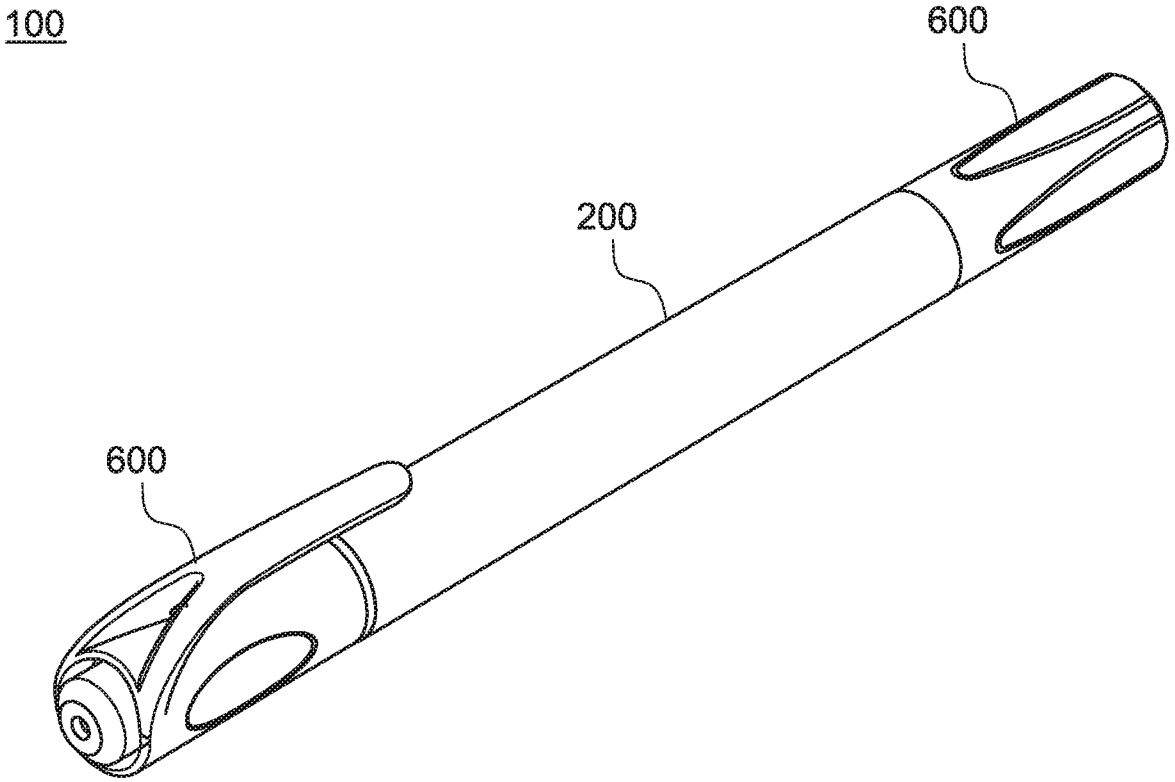
FIG. 1 is a perspective view of one embodiment of a multi-function writing implement of the present invention.

Referring now to the drawings where like characteristics and features among the various figures are denoted by like reference characters.

Figure 2:
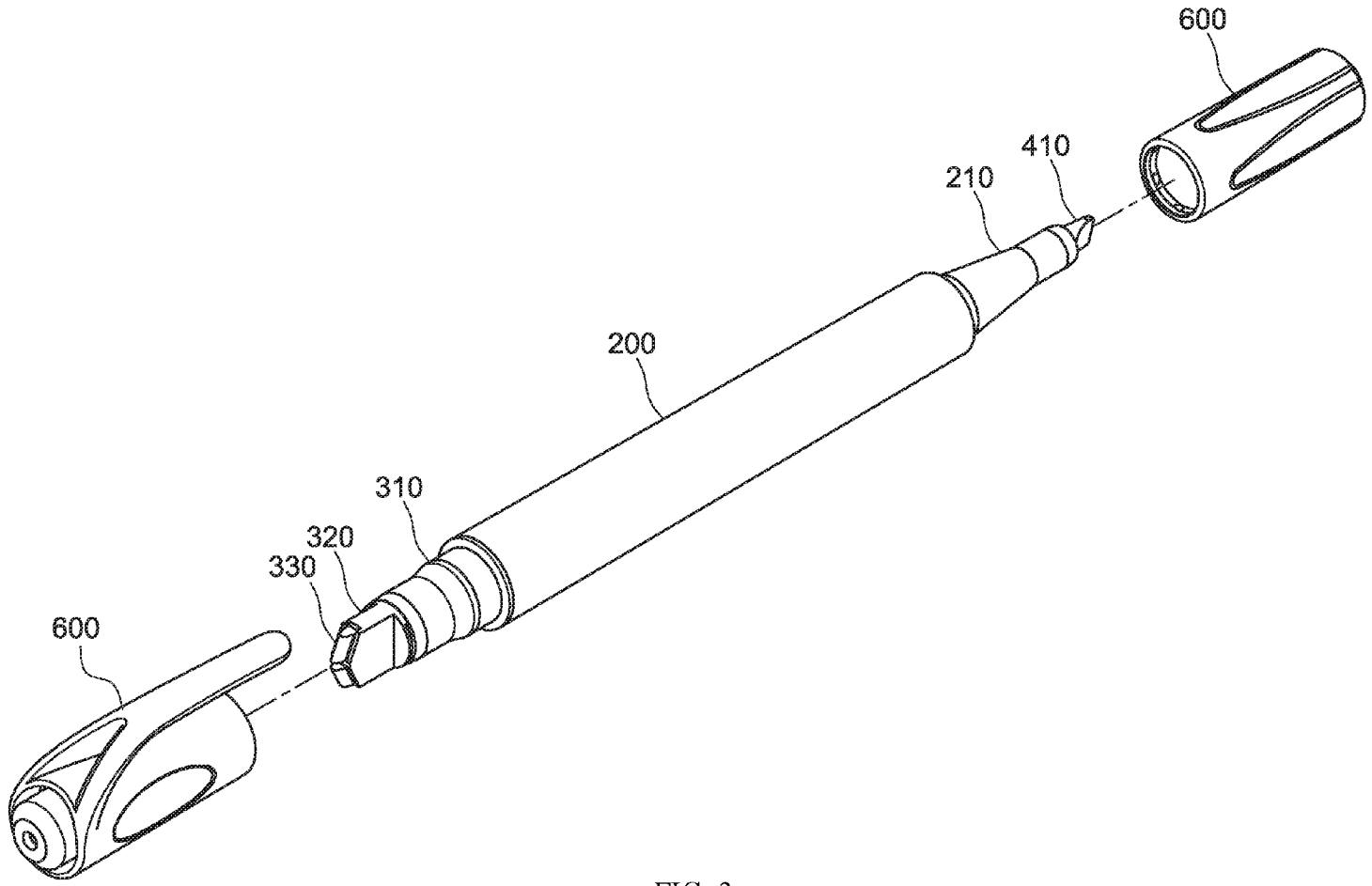
FIG. 2 is a perspective view of the multi-function writing implement in FIG. 1 while separating from the two caps.
Figure 3:
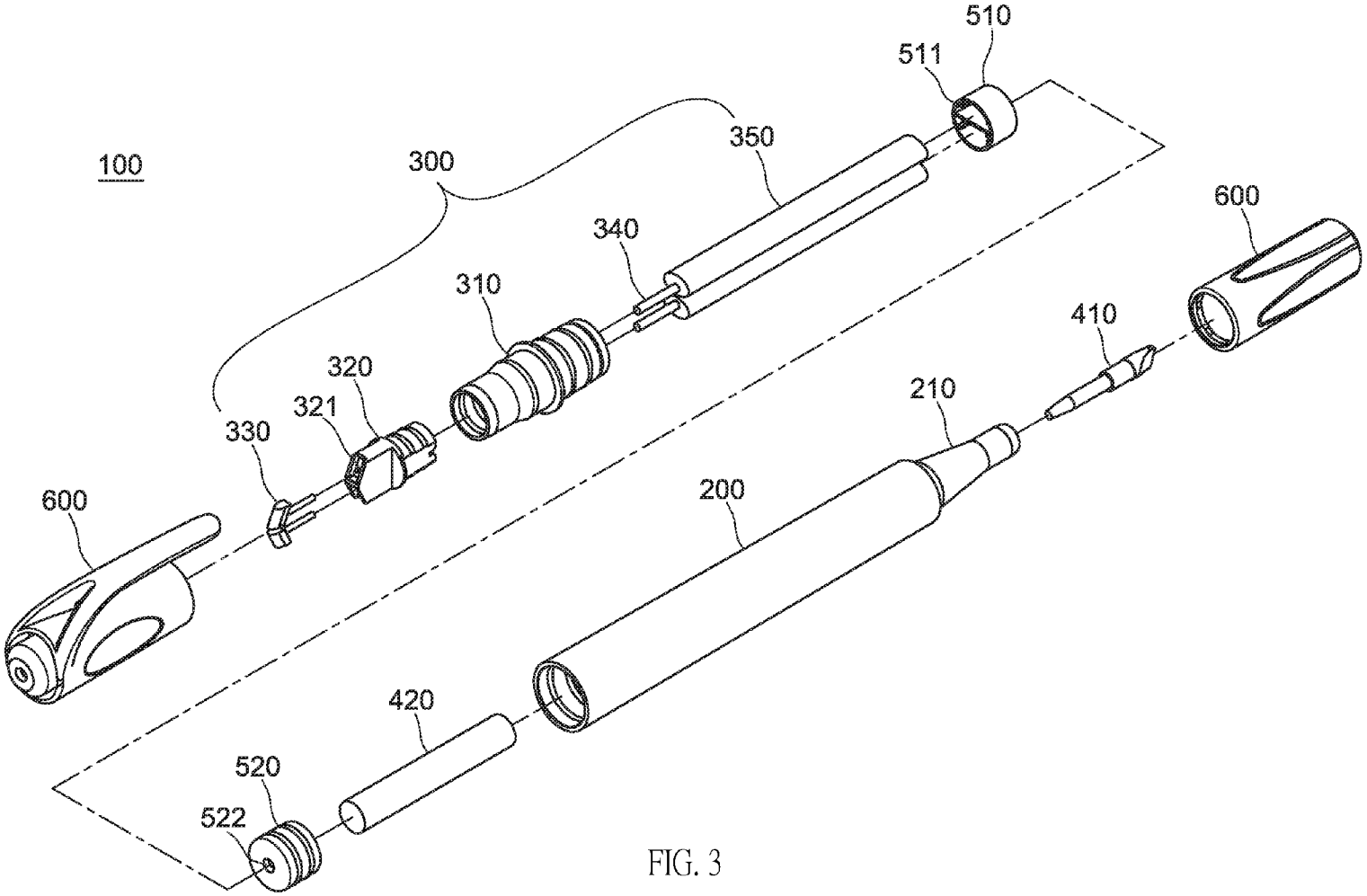
FIG. 3 is an exploded view of the multi-function writing implement in FIG. 1.
Figure 4:
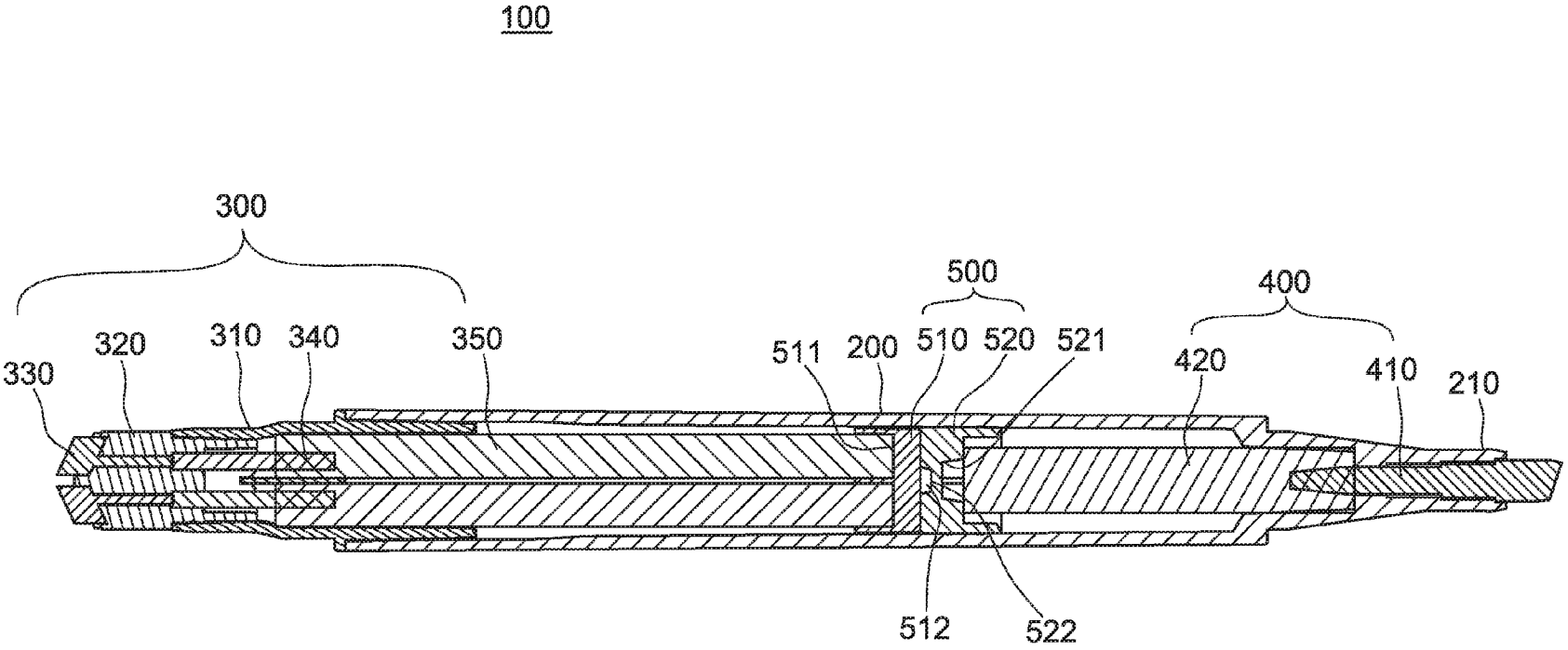
FIG. 4 is a cross-sectional view of the multi-function writing implement in FIG. 1 after separating from two caps.

Please refer to FIGS. 1 to 4, FIG. 1 is a perspective view of one embodiment of a multi-function writing implement 100 of the present invention, FIG. 2 is a perspective view of the multi-function writing implement 100 in FIG. 1 while separating from the two caps 600, FIG. 3 is an exploded view of the multi-function writing implement 100 in FIG. 1, FIG. 4 is a cross-sectional view of the multi-function writing implement 100 in FIG. 1 after separating from two caps 600.

The multi-function writing implement 100 may comprise a pen shaft 200, a colored pen assembly 300, an erasing pen assembly 400, a spacing assembly 500, and two caps 600.

The pen shaft 200 is a hollow tube for receiving the colored pen assembly 300*m* the erasing pen assembly 400, and the spacing assembly 500. The pen shaft 200 has a tapered seat 210.

The colored pen assembly 300 is arranged at one end of the pen shaft 200 and includes a cartridge seat 310, a nib seat 320, a plurality of colored cartridges 330, a plurality of relay cartridges 340, and a plurality of colored ink cotton tubes 350. The cartridge seat 310 is connected to the end of the pen shaft 200. The nib seat 320 is connected to the cartridge seat 310 and one end of the nib seat 320 has a plurality of cartridge slots 321. The colored cartridges 330 are respectively arranged at the cartridge slots 321. The relay cartridges 340 are respectively connected to the colored cartridges 330 and arranged in the cartridge seat 310. The colored ink cotton tubes 350 are respectively connected to the relay cartridges 340 and arranged in the pen shaft 200 and the cartridge 310 in parallel. In this embodiment, the number of the cartridge slots 321, the colored cartridges 330, the relay cartridges 340, and the colored ink cotton tubes 350 is two, but not limited thereto. If the multi-function writing implement 100 may draw three colors, the number of the cartridge slots 321, the colored cartridges 330, the relay cartridges 340, and the colored ink cotton tubes 350 may be three, and so on.

The erasing pen assembly 400 is arranged at the other end of the pen shaft 200 opposite to the colored pen assembly 300 and the erasing pen assembly 400 includes an erasing cartridge 410 and an ink erasing cotton tube 420. The erasing cartridge 410 is arranged at the tapered seat 210. The ink erasing cotton tube 420 is connected to the erasing cartridge 410. The ink received in the ink erasing cotton tube 420 of the erasing pen assembly 400 may erase the ink received in the colored ink cotton tube 350 of the erasing pen assembly 300. The ink erasing principle is prior art and the description is omitted.

The spacing assembly 500 is arranged between the colored pen assembly 300*y* and the erasing pen assembly 400. The spacing assembly 500 includes a first spacing stopper 510 and a second spacing stopper 520. The first spacing stopper 510 has two semi-circular grooves 511 and a convex end 512. The two semi-circular grooves 511 are used for receiving the colored ink cotton tubes 350. The second spacing stopper 520 has a circular groove 521 and a wedge slot 522. The circular groove 521 is used for receiving the ink erasing cotton tube 420. The convex end 512 is fastened to and corresponding to the wedge slot 522 so that the first spacing stopper 510 and the second spacing stopper 520 are firmly connected with each other. The structure of the two semi-circular grooves 511 of the first spacing stopper 510 may be changed based on the number of the colored ink cotton tube 350.

Two caps 600 are respectively arranged at two ends of the pen shaft 200. One of the two caps 600 may cover the cartridge seat 310 and the other one of the two caps 600 may cover the tapered seat 210. The two caps 600 may respectively protect the colored cartridge 330 and the erasing cartridge 410. Although one of the two caps 600 illustrated in FIG. 1 has a hook structure, two caps 600 may have the hook structure or not for both in other embodiments.

In conclusion, the multi-function writing implement 100 may have following advantages.

Firstly, one end of the multi-function writing implement 100 has the colored cartridge 330 capable for drawing two different colors and the other end thereof has the erasing cartridge 410 for erasing the ink.

Secondly, the additional arrangement is the nib seat 320 and the cartridge slots 321 for positioning the colored cartridge 330 so as to prevent from being easily damaged the colored cartridge in prior art and to extend the service life of the colored cartridge 330.

Thirdly, the additional arrangement is the relay cartridges 340 for promoting the colored cartridge 330 to absorb the ink.

Fourthly, the additional arrangement is the spacing assembly 500 for separating the colored pen assembly 300 and the erasing pen assembly 400 from each other which are respectively arranged at two ends of the pen shaft 200. Besides the first spacing stopper 510 and the second spacing stopper 520 may respectively engage with the colored ink cotton tube 350 and the ink erasing cotton tube 420, the first spacing stopper 510 and the second spacing stopper 520 may be engaged with each other for positioning so as to enhance the mechanical strength of the elements in the multi-function writing implement 100.

Fifthly, the nib seat 320 may be made by transparent materials so that the user may see the colored cartridge 330 directly and the multi-function writing implement 100 may be more attractive and beautiful.

The foregoing descriptions are merely the exemplified embodiments of the present invention, where the scope of the claim of the present invention is not intended to be limited by the embodiments. Any equivalent embodiments or modifications without departing from the spirit and scope of the present invention are therefore intended to be embraced.

The disclosed structure of the invention has not appeared in the prior art and features efficacy better than the prior structure which is construed to be a novel and creative invention, thereby filing the present application herein subject to the patent law.

What is claimed is:

1. A multi-function writing implement, comprising:

a pen shaft;

a colored pen assembly, arranged at one end of the pen shaft and including:

a cartridge seat, connected to the end of the pen shaft;

a nib seat, connected to the cartridge seat, one end of the nib seat has a plurality of cartridge slots;

a plurality of colored cartridges, respectively arranged at the cartridge slots;

a plurality of relay cartridges, respectively connected to the colored cartridges and arranged in the cartridge seat; and a plurality of colored ink cotton tubes, respectively connected to the relay cartridges and arranged in the pen shaft and the cartridge in parallel; and an erasing pen assembly, arranged at the other end of the pen shaft opposite to the colored pen assembly, the erasing pen assembly includes:

an erasing cartridge; and an ink erasing cotton tube, connected to the erasing cartridge;

a spacing assembly, arranged between the colored pen assembly and the erasing pen assembly, the spacing assembly includes a first spacing stopper and a second spacing stopper, the first spacing stopper has two semi-circular grooves for receiving the colored ink cotton tubes, and the second spacing stopper has a circular groove for receiving the ink erasing cotton tube;

wherein the number of the cartridge slots, the colored cartridges, the relay cartridges, and the colored ink cotton tubes is two.

2. The multi-function writing implement as claimed in claim 1, wherein the first spacing stopper further includes a convex end and the second spacing stopper further includes a wedge slot, and the convex end is fastened to and corresponding to the wedge slot.

3. The multi-function writing implement as claimed in claim 1, wherein the pen shaft has a tapered seat for providing the erasing cartridge to arrange.

4. The multi-function writing implement as claimed in claim 3, further comprising two caps, one of the two caps covers the cartridge seat and the other one of the two caps covers the tapered seat.

5. The multi-function writing implement as claimed in claim 1, wherein the nib seat is made of transparent materials.

* * * * *